US008384303B2

(12) United States Patent
Chang

(10) Patent No.: US 8,384,303 B2
(45) Date of Patent: Feb. 26, 2013

(54) FLUORESCENT-BASED ELECTROLUMINESCENT LIGHTING

(75) Inventor: Hui Huang Chang, Hsinchu County (TW)

(73) Assignee: Empire Technology Development LLC, Wilmington, DE (US)

( * ) Notice: Subject to any disclaimer, the term of this patent is extended or adjusted under 35 U.S.C. 154(b) by 316 days.

(21) Appl. No.: 12/710,508

(22) Filed: Feb. 23, 2010

(65) Prior Publication Data

US 2011/0204813 A1 Aug. 25, 2011

(51) Int. Cl.
*H05B 37/02* (2006.01)

(52) U.S. Cl. ..... 315/291; 315/294; 315/297; 315/307; 315/312

(58) Field of Classification Search ..... 315/291, 315/209 R, 185 R, 294, 297
See application file for complete search history.

(56) References Cited

U.S. PATENT DOCUMENTS

| | | | | |
|---|---|---|---|---|
| 4,508,993 | A | 4/1985 | Anderson | |
| 6,762,562 | B2 | 7/2004 | Leong | |
| 7,067,992 | B2 | 6/2006 | Leong | |
| 2004/0189218 | A1 * | 9/2004 | Leong et al. | 315/291 |
| 2005/0110426 | A1 * | 5/2005 | Shao | 315/185 R |
| 2008/0062680 | A1 * | 3/2008 | Timmermans et al. | 362/223 |

OTHER PUBLICATIONS http://www.everled.com/content/11/EverLEDTR.html.

* cited by examiner

*Primary Examiner* — Douglas W Owens
*Assistant Examiner* — Jonathan Cooper
(74) *Attorney, Agent, or Firm* — Ren-Sheng International

(57) ABSTRACT

An electroluminescent tube compatible with a conventional fluorescent lighting system is generally described in the present disclosure. One example electroluminescent tube may include a rectifying circuit, a driving circuit, and an electroluminescent device. The driving circuit is configured to drive the electroluminescent device upon receiving a power signal. The rectifying circuit is configured to bypass a starter route and also direct the power signal to the driving circuit through a power input route.

18 Claims, 10 Drawing Sheets

FLUORESCENT-BASED ELECTROLUMINESCENT LIGHTING

BACKGROUND

Fluorescent lighting systems are widely used in various applications. In recent years, electroluminescent technologies, such as light-emitting diodes (LEDs), have rapidly gained popularity due to their low power consumption. Since fluorescence and electroluminescence are different optical phenomena, the driving methods of both types of lighting systems vary significantly.

DETAILED DESCRIPTION

Figure 1:
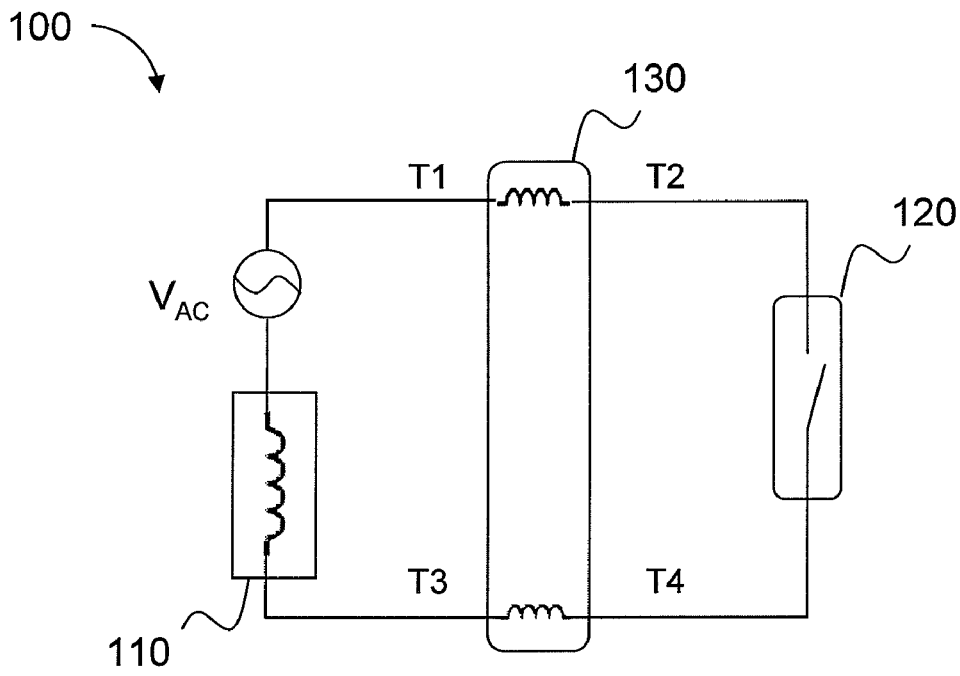
FIG. 1 (PRIOR ART)
FIG. 1 shows a simplified block diagram of a conventional fluorescent lighting system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is drawn, inter alia, to fluorescent-based electroluminescent lighting systems and will be described herein.

FIG. 1 shows a simplified block diagram of a conventional fluorescent lighting system 100. The fluorescent lighting system 100 includes a ballast 110, a starter 120, and a fluorescent tube 130. The fluorescent tube 130 is an arc discharge lamp having an elongated glass envelope with a phosphor coating on an inner wall thereof, and containing an inert gas and a small amount of mercury. The fluorescent tube 130 includes two heaters disposed at both ends of the tube for ionizing the inert gas. The ballast 110 is typically a transformer, which controls the initialization and operation by regulating the current flow of the fluorescent tube 130. The starter 120 is a normally-open switching device having two contact strips, one of which may be a bimetallic strip. The starter 120 is also enclosed in a glass envelop filled with inert gas. Upon receiving an input signal from a power source $V_{AC}$, the ballast 110 generates a current that flows through the heaters of the fluorescent tube 130 and the contact strips of the starter 120. While the voltage across the fluorescent tube 130 is not yet sufficient to cause initial ionization for the fluorescent tube 130, the electrical field created between the two contact strips of the starter 120 is sufficient to ionize the gas inside the glass envelop for the starter 120. An electrical arc between the two contact strips of the starter 120 occurs, and a "starter route" generally refers to this ionized path established between the two contact strips. A short time later, the heat generated due to ionization bends the bimetallic strip toward the other strip. After the two contact strips make contact, the gas inside the glass envelop for the starter 120 de-ionizes, and the bimetallic strip resumes its original position, thereby breaking the starter route. The sudden increase in impedance and the sharp reduction in current causes a large striking voltage across the ballast 110, which in turn provides a voltage kick for ionizing the fluorescent tube 130.

Unlike the fluorescent lighting system 100, which requires having the starter 120 to be operational, the present disclosure describes various embodiments of an electroluminescent lighting system that does not require a starter. However, to retrofit existing fluorescent lighting systems to support energy-efficient electroluminescent devices, the present disclosure also describes some embodiments of an electroluminescent lighting system that includes a starter and a mechanism for managing the voltage kick from operating the starter.

Figure 2:
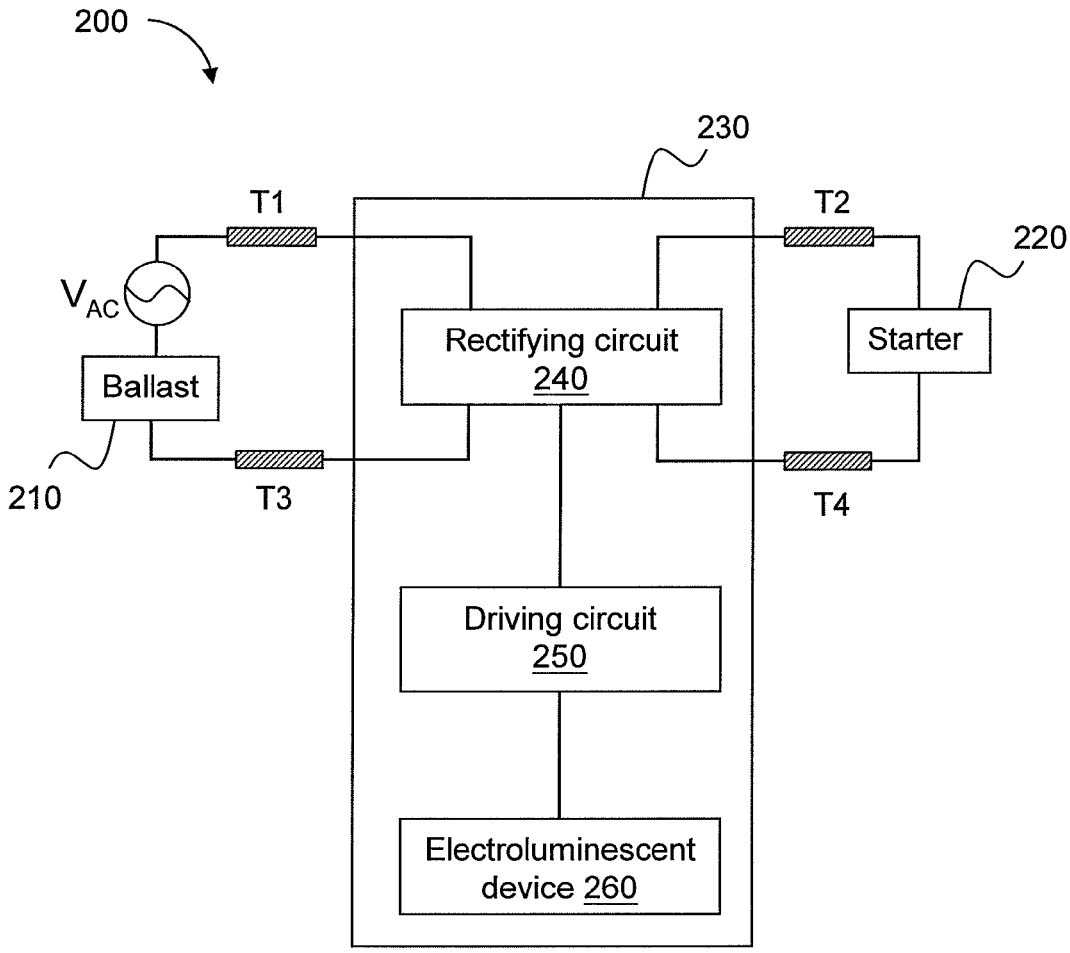
FIG. 2 shows a simplified block diagram of an illustrative embodiment of a fluorescent-based electroluminescent lighting system.

FIG. 2 shows a simplified block diagram of an illustrative embodiment of a fluorescent-based electroluminescent lighting system 200. The fluorescent-based electroluminescent lighting system 200 may include a ballast 210, a starter 220, and an electroluminescent tube 230. The electroluminescent tube 230 may include a rectifying circuit 240, a driving circuit 250, and an electroluminescent device 260. The electroluminescent tube 230 may be installed in the fluorescent-based electroluminescent lighting system 200 in different orientations with respect to the ballast 210 and the starter 220. The fluorescent-based electroluminescent lighting system 200 may also support four terminals, T1, T2, T3, and T4 that couple the ballast 210 and the starter 220 to the rectifying circuit 240 of the electroluminescent tube 230.

Depending on the desired configuration, the ballast 210 may be of any type including but not limited to a magnetic ballast or an electronic ballast. The ballast 210 may be configured to provide a power signal to the electroluminescent tube 230 based on an input voltage $V_{AC}$, such as from an 110V-240V AC power supply.

Depending on the desired configuration, the driving circuit 250 may be of any type including but not limited to a constant current driver driving circuit, a constant voltage driver driving circuit, an adjustable current driver driving circuit, an adjustable voltage driver driving circuit, or a multi-functional driver. The driving circuit 250 may be configured to support multiple lighting options as well as multiple color selections.

The electroluminescent device 260 may be of any type including but not limited to LEDs.

Depending on the desired configuration, the rectifying circuit 240 may be implemented using any type including but not limited to full bridge rectifiers, half bridge rectifiers, or any combination thereof. The rectifying circuit 240 may be configured to bypass the starter route, so that the large voltage kick resulting from operating the starter 220, which may damage the electroluminescent device 260, may be avoided.

In addition, the rectifying circuit 240 may be configured to support a power input route through which the power signal from the ballast 210 may be transmitted to the driving circuit 250 regardless of the orientation of the electroluminescent tube 230. The ballast 210, the starter 220, and the electroluminescent tube 230 may be configured to be compatible with any conventional fluorescent lighting system.

FIGS. 3-6 show circuit diagrams of various illustrative embodiments of the fluorescent-based electroluminescent lighting system 200 of FIG. 2. In the four illustrated embodiments, the rectifying circuit 240 may include two full bridge rectifiers, each having four diodes (e.g., D1-D4 or D5-D7). The two full bridge rectifiers may be coupled to the four terminals T1-T4 of the fluorescent-based electroluminescent lighting system 200 in different ways.

Figure 3:
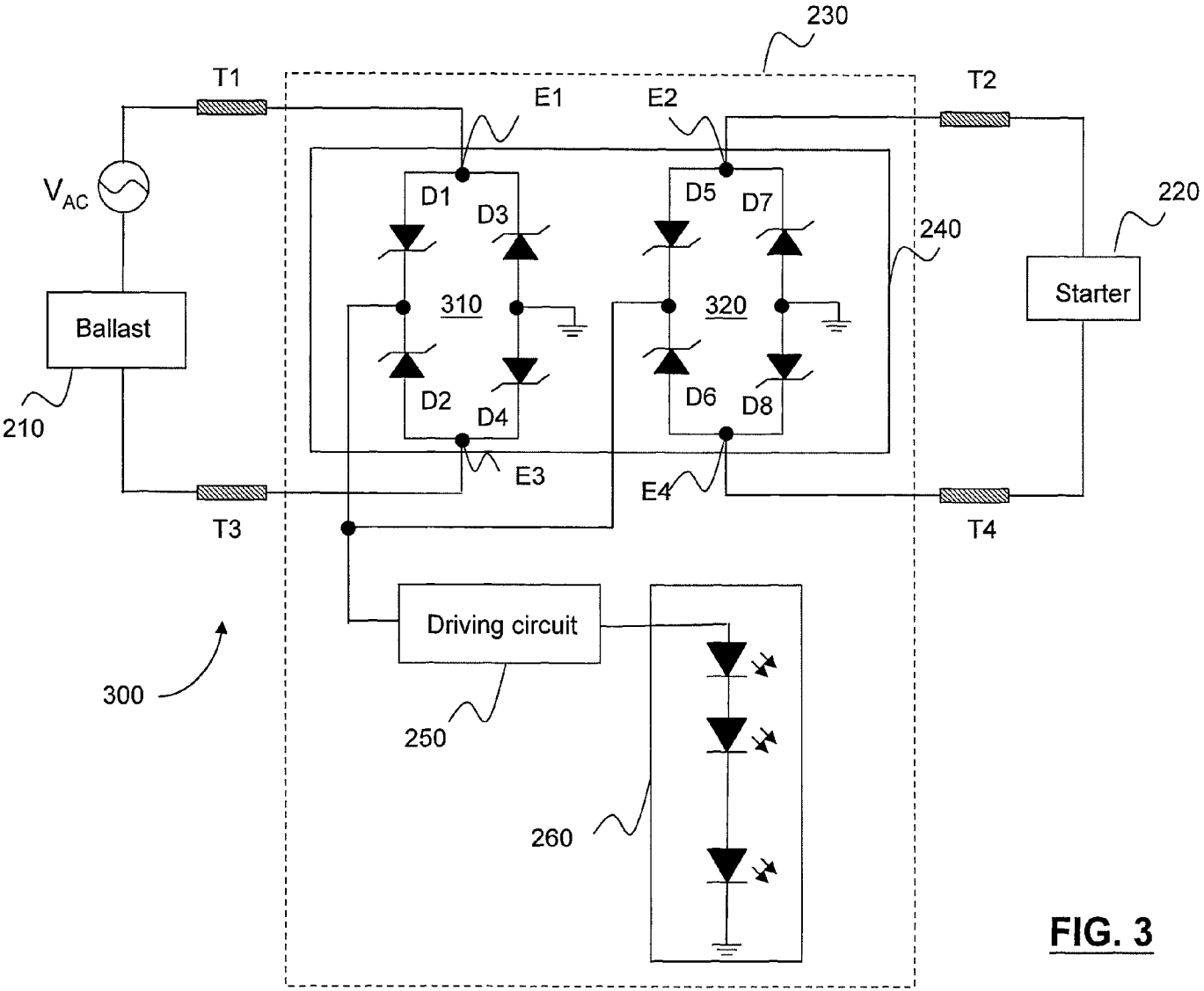
FIG. 3 shows a circuit diagram of a first illustrative embodiment the fluorescent-based electroluminescent lighting system of FIG. 2.

FIG. 3 shows a fluorescent-based electroluminescent lighting system 300 in which the electroluminescent tube 230 may be installed in a first orientation, so that the electrodes E1 and E3 for a first full bridge rectifier 310 are coupled to terminals T1 and T3, respectively, and the electrodes E2 and E4 for a second full bridge rectifier 320 are coupled to terminals T2 and T4, respectively. The first full bridge rectifier 310 may include four diodes, D1 to D4. An anode of D1 may be coupled to the electrode E1, and a cathode of the same D1 may be coupled to the driving circuit 250. An anode of D2 may be coupled to the electrode E3, and a cathode of the same D2 may be coupled to the driving circuit 250. An anode of D3 may be coupled to a bias voltage (e.g., ground), and a cathode of the same D3 may be coupled to the electrode E1. An anode of D4 may be coupled to the same bias voltage, and a cathode of the same D4 may be coupled to the electrode E3.

When the fluorescent-based electroluminescent lighting system 300 is turned on, the power signal provided by the ballast 210 may be transmitted to the driving circuit 250 and the electroluminescent device 260 via a first power input route between the electrodes E1 and E3 supported by the first full bridge rectifier 310. Moreover, given this first orientation of the electroluminescent tube 230, the electrodes E2 and E4 supported by the second full bridge rectifier 320 may be configured not to be in operation, thus bypassing the starter router associated with the starter 220. During a positive cycle of the input voltage $V_{AC}$, the power signal may travel through the first power input route in the following sequence: E1→D1→the driving circuit 250→the electroluminescent device 260→D4→E3. During a negative cycle of the input voltage $V_{AC}$, the power signal may travel through the first power input route in the following sequence: E3→D2→the driving circuit 250→the electroluminescent device 260→D3→E1.

Figure 4:
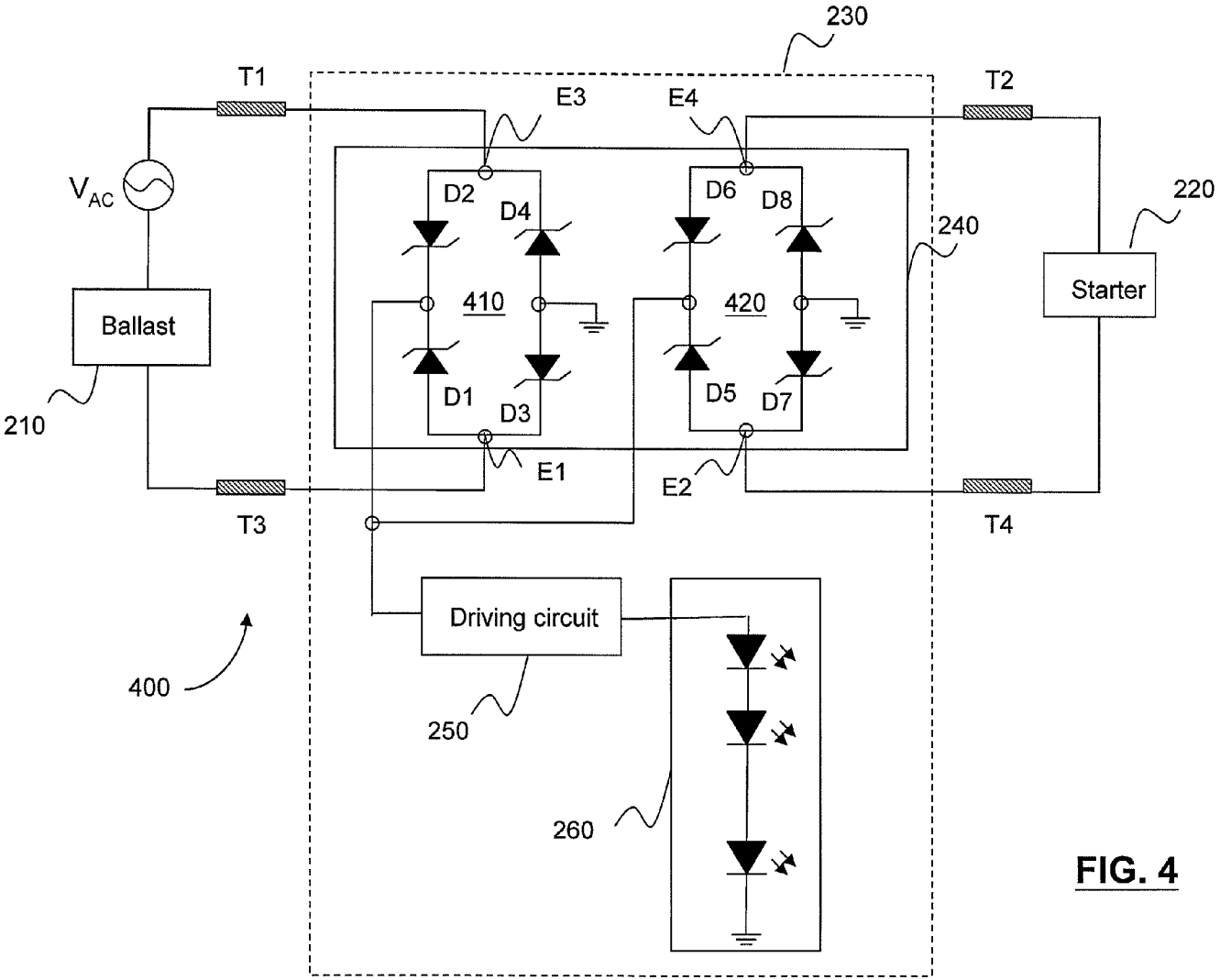
FIG. 4 shows a circuit diagram of a second illustrative embodiment the fluorescent-based electroluminescent lighting system of FIG. 2.

FIG. 4 shows a fluorescent-based electroluminescent lighting system 400 in which the electroluminescent tube 230 may be installed in a second orientation, so that the electrodes E1 and E3 for a first full bridge rectifier 410 are coupled to terminals T3 and T1, respectively, and the electrodes E2 and E4 for a second full bridge rectifier 420 are coupled to terminals T4 and T2, respectively. The first full bridge rectifier 410 may include four diodes, D1 to D4. An anode of D1 may be coupled to the electrode E1, and a cathode of the same D1 may be coupled to the driving circuit 250. An anode of D2 may be coupled to the electrode E3, and a cathode of the same D2 may be coupled to the driving circuit 250. An anode of D3 may be coupled to a bias voltage (e.g., ground), and a cathode of the same D3 may be coupled to the electrode E1. An anode of D4 may be coupled to the same bias voltage, and a cathode of the same D4 may be coupled to the electrode E3.

When the fluorescent-based electroluminescent lighting system 400 is turned on, the power signal provided by the ballast 210 may be transmitted to the driving circuit 250 and the electroluminescent device 260 via a second power input route between the electrodes E3 and E1 supported by the first full bridge rectifier 410. Moreover, given this second orientation of the electroluminescent tube 230, the electrodes E4 and E2 supported by the second full bridge rectifier 420 may be configured not to be in operation, thus bypassing the starter router associated with the starter 220. During a positive cycle of the input voltage $V_{AC}$, the power signal may travel through the second power input route in the following sequence: E3→D2→the driving circuit 250→the electroluminescent device 260→D3→E1. During a negative cycle of the input voltage $V_{AC}$, the power signal may travel through the second power input route in the following sequence: E1→D1→the driving circuit 250→the electroluminescent device 260→D4→E3.

Figure 5:
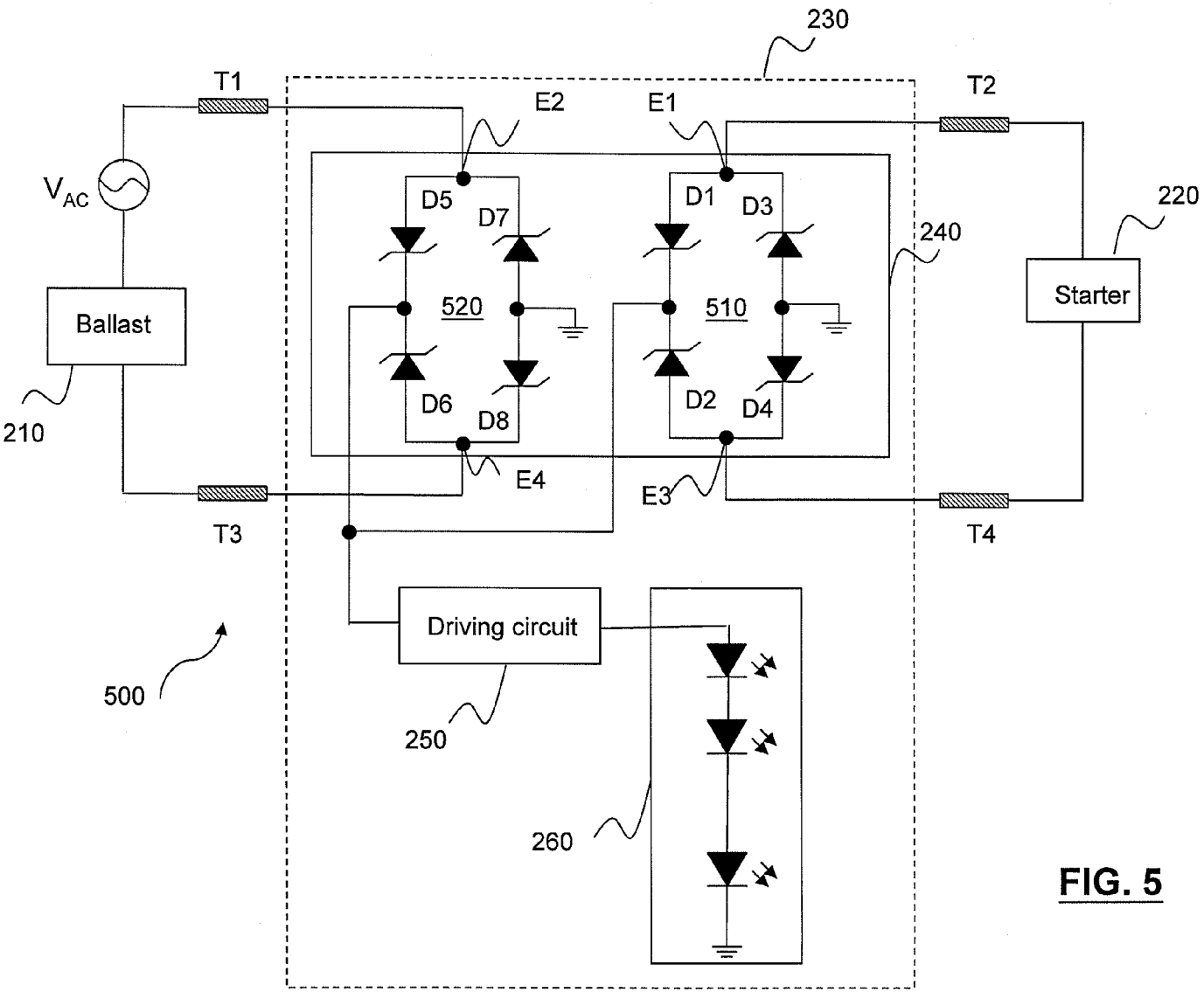
FIG. 5 shows a circuit diagram of a third illustrative embodiment the fluorescent-based electroluminescent lighting system of FIG. 2.

FIG. 5 shows a fluorescent-based electroluminescent lighting system 500 in which the electroluminescent tube 230 may be installed in a third orientation, so that the electrodes E2 and E4 for a second full bridge rectifier 520 are coupled to terminals T1 and T3, respectively, and the electrodes E1 and E3 for a first full bridge rectifier 510 are coupled to terminals T2 and T4, respectively. The second full bridge rectifier 520 may include four diodes, D5 to D8. An anode of D5 may be coupled to the electrode E2, and a cathode of the same D5 may be coupled to the driving circuit 250. An anode of D6 may be coupled to the electrode E4, and a cathode of the same D6 may be coupled to the same driving circuit 250. An anode of D7 may be coupled to a bias voltage (e.g., ground), and a cathode of the same D7 may be coupled to the electrode E2. An anode of D8 may be coupled to the same bias voltage, and a cathode of the same D8 may be coupled to the electrode E4.

When the fluorescent-based electroluminescent lighting system 500 is turned on, the power signal provided by the ballast 210 may be transmitted to the driving circuit 250 and the electroluminescent device 260 via a third power input route between the electrodes E2 and E4 supported by the second full bridge rectifier 520. Moreover, given this third orientation of the electroluminescent tube 230, the electrodes E1 and E3 supported by the first full bridge rectifier 510 may be configured not to be in operation, thus bypassing the starter router associated with the starter 220. During a positive cycle of the input voltage $V_{AC}$, the power signal may travel through the third power input route in the following sequence: E2→D5→the driving circuit 250→the electroluminescent device 260→D8→E4. During a negative cycle of the input voltage $V_{AC}$, the power signal may travel through the third power input route in the following sequence: E4→D6→the driving circuit 250→the electroluminescent device 260→D7→E2.

Figure 6:
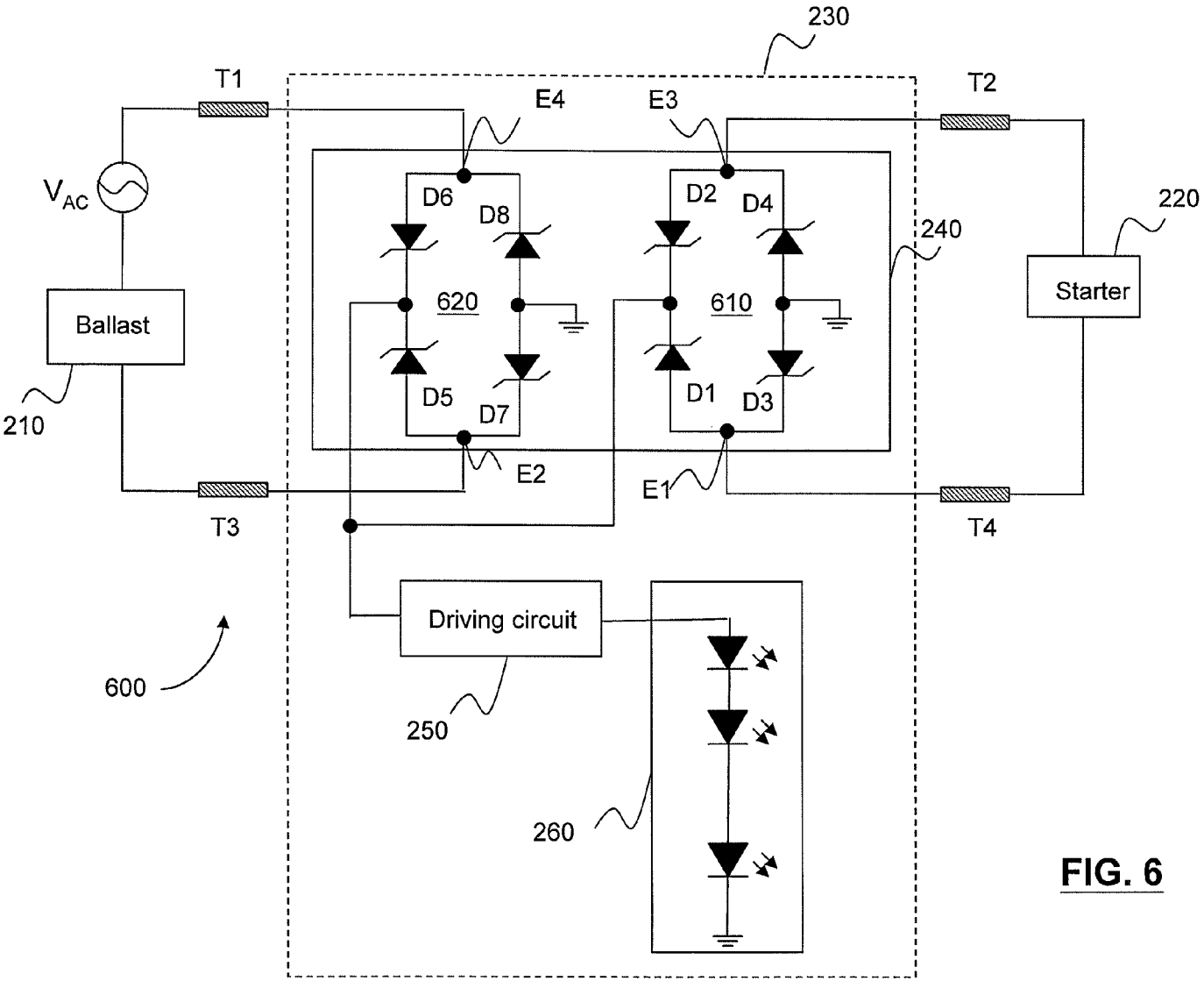
FIG. 6 shows a circuit diagram of a fourth illustrative embodiment the fluorescent-based electroluminescent lighting system of FIG. 2.

FIG. 6 shows a fluorescent-based electroluminescent lighting system 600 in which the electroluminescent tube 230 may be installed in a fourth orientation, so that the electrodes E2 and E4 for a second full bridge rectifier 620 are coupled to terminals T3 and T1, respectively, and the electrodes E1 and E3 for a first full bridge rectifier 610 are coupled to terminals T4 and T2, respectively. The second full bridge rectifier 620 may include four diodes, D5 to D8. An anode of D5 may be coupled to the electrode E2, and a cathode of the same D5 may be coupled to the driving circuit 250. An anode of D6 may be coupled to the electrode E4, and a cathode of the same D6 may be coupled to the same driving circuit 250. An anode of D7 may be coupled to a bias voltage (e.g., ground), and a cathode of the same D7 may be coupled to the electrode E2. An anode of D8 may be coupled to the same bias voltage, and a cathode of the same D8 may be coupled to the electrode E4.

When the fluorescent-based electroluminescent lighting system 600 is turned on, the power signal provided by the ballast 210 may be transmitted to the driving circuit 250 and the electroluminescent device 260 via a fourth power input route between the electrodes E4 and E2 supported by the second full bridge rectifier 520. Moreover, given this fourth orientation of the electroluminescent tube 230, the electrodes E3 and E1 supported by the first full bridge rectifier 610 may be configured not to be in operation, thus bypassing the starter router associated with the starter 220. During a positive cycle of the input voltage $V_{AC}$, the power signal may travel through the fourth power input route in the following sequence: E4→D6→the driving circuit 250→the electroluminescent device 260→D7→E2. During a negative cycle of the input voltage $V_{AC}$, the power signal may travel through the fourth power input route in the following sequence: E2→D5→the driving circuit 250→the electroluminescent device 260→D8→E4.

FIGS. 7-10 show circuit diagrams of various illustrated embodiments of the fluorescent-based electroluminescent lighting system 200 of FIG. 2. In the four illustrated embodiments, the rectifying circuit 240 may include two half bridge rectifiers, each having two diodes (e.g., D1-D2 or D3-D4). The two half bridge rectifiers may be coupled to the four terminals T1-T4 of the fluorescent-based electroluminescent lighting system 200 in different ways.

Figure 7:
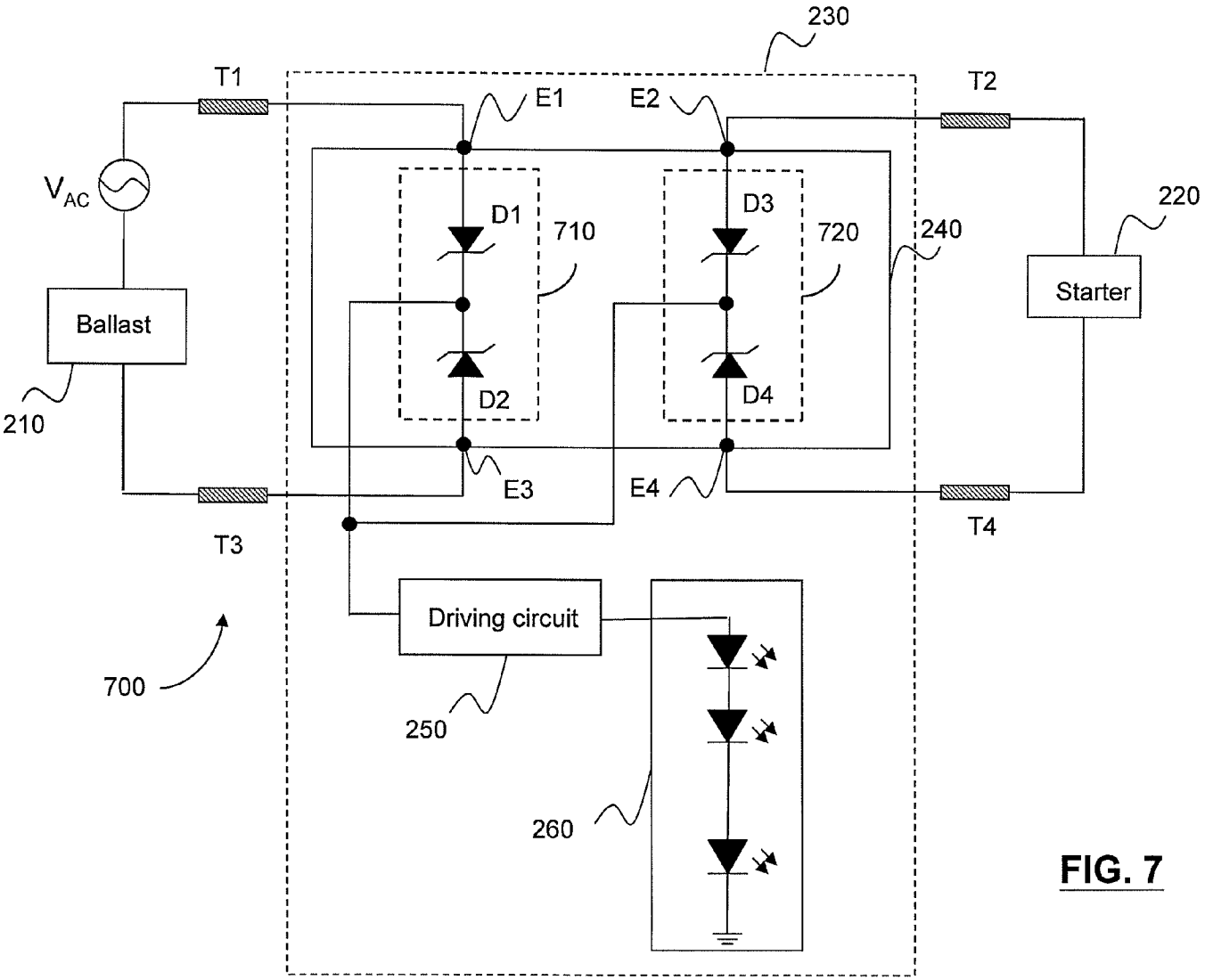
FIG. 7 shows a circuit diagram of a fifth illustrative embodiment the fluorescent-based electroluminescent lighting system of FIG. 2.

FIG. 7 shows a fluorescent-based electroluminescent lighting system 700 in which the electroluminescent tube 230 may be installed in a fifth orientation, so that the electrodes E1 and E3 for a first half bridge rectifier 710 are coupled to terminals T1 and T3, respectively, and the electrodes E1 and E3 for a second half bridge rectifier 720 are coupled to terminals T2 and T4, respectively. The first full bridge rectifier 710 may include two diodes, D1 and D2. An anode of D1 may be coupled to the electrode E1, and a cathode of the same D1 may be coupled to the driving circuit 250. An anode of D2 may be coupled to the electrode E3, and a cathode of the same D2 may be coupled to the same driving circuit 250.

When the fluorescent-based electroluminescent lighting system 700 is turned on, the power signal provided by the ballast 210 may be transmitted to the driving circuit 250 and the electroluminescent device 260 via a fifth power input route between the electrodes E1 and E3 supported by the first half bridge rectifier 710. Moreover, given this fifth orientation of the electroluminescent tube 230, the electrodes E2 and E4 supported by the second half bridge rectifier 720 may be configured not to be in operation, thus bypassing the starter router associated with the starter 220. When a positive cycle of the input voltage $V_{AC}$ may be utilized, the power signal may travel through the fifth power input route from D1 to the driving circuit 250. When a negative cycle of the input voltage $V_{AC}$ may be utilized, the power signal may travel through the fifth power input route from D2 to the driving circuit 250.

Figure 8:
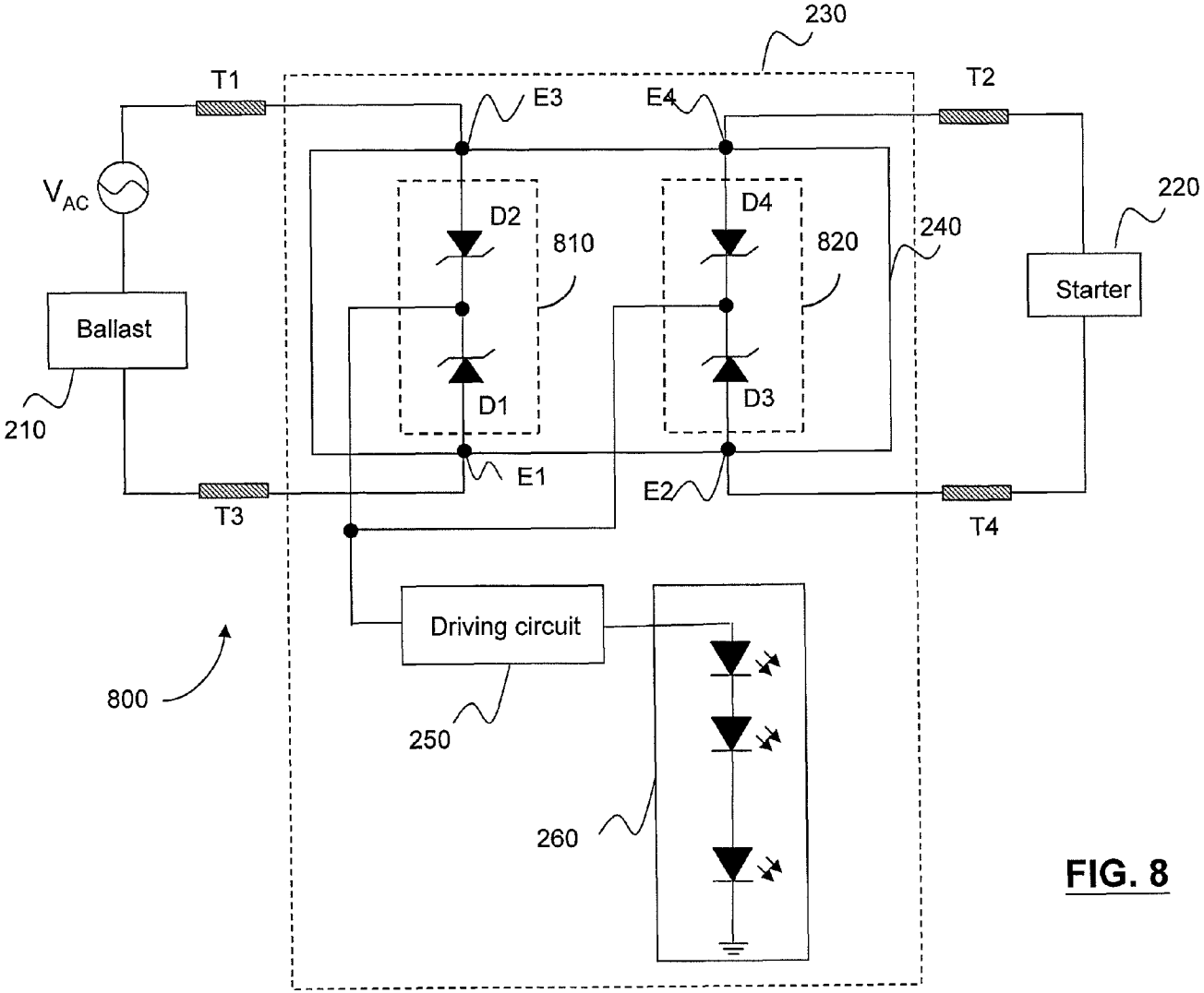
FIG. 8 shows a circuit diagram of a sixth illustrative embodiment the fluorescent-based electroluminescent lighting system of FIG. 2.

FIG. 8 shows a fluorescent-based electroluminescent lighting system 800 in which the electroluminescent tube 230 may be installed in a sixth orientation, so that the electrodes E3 and E1 for a first half bridge rectifier 810 are coupled to terminals T1 and T3, respectively, and the electrodes E4 and E2 for a second half bridge rectifier 820 are coupled to terminals T2 and T4, respectively. The first full bridge rectifier 810 may include two diodes, D1 and D2. An anode of D1 may be coupled to the electrode E1, and a cathode of the same D1 may be coupled to the driving circuit 250. An anode of D2 may be coupled to the electrode E3, and a cathode of the same D2 may be coupled to the same driving circuit 250.

When the fluorescent-based electroluminescent lighting system 800 is turned on, the power signal provided by the ballast 210 may be transmitted to the driving circuit 250 and the electroluminescent device 260 via a sixth power input route between the electrodes E3 and E1 supported by the first half bridge rectifier 810. Moreover, given this sixth orientation of the electroluminescent tube 230, the electrodes E4 and E2 supported by the second half bridge rectifier 820 may be configured not to be in operation, thus bypassing the starter router associated with the starter 220. When a positive cycle of the input voltage $V_{AC}$ may be utilized, the power signal may travel through the sixth power input route from D2 to the driving circuit 250. When a negative cycle of the input voltage $V_{AC}$ may be utilized, the power signal may travel through the sixth power input route from D1 to the driving circuit 250.

Figure 9:
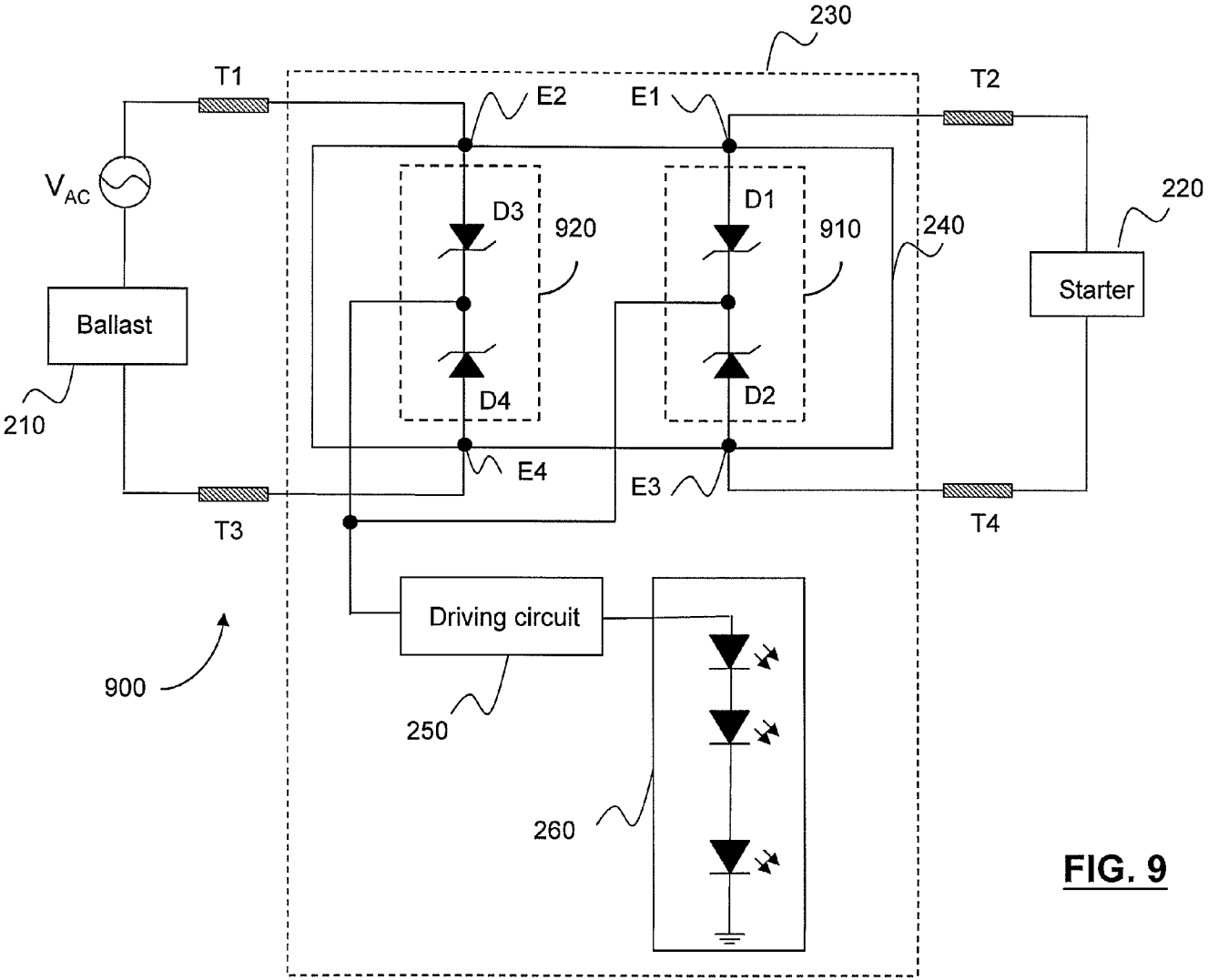
FIG. 9 shows a circuit diagram of a seventh illustrative embodiment the fluorescent-based electroluminescent lighting system of FIG. 2.

FIG. 9 shows a fluorescent-based electroluminescent lighting system 900 in which the electroluminescent tube 230 may be installed in a seventh orientation, so that the electrodes E2 and E4 for a second half bridge rectifier 920 are coupled to terminals T1 and T3, respectively, and the electrodes E1 and E3 for a first half bridge rectifier 910 are coupled to terminals T2 and T4, respectively. The second half bridge rectifier 920 may include two diodes, D3 and D4. An anode of D3 may be coupled to the electrode E2, and a cathode of the same D3 may be coupled to the driving circuit 250. An anode of D4 may be coupled to the electrode E4, and a cathode of the same D4 may be coupled to the same driving circuit 250.

When the fluorescent-based electroluminescent lighting system 900 is turned on, the power signal provided by the ballast 210 may be transmitted to the driving circuit 250 and the electroluminescent device 260 via a seventh power input route between the electrodes E4 and E2 supported by the second half bridge rectifier 920. Moreover, given this seventh orientation of the electroluminescent tube 230, the electrodes E3 and E1 supported by the first half bridge rectifier 910 may be configured not to be in operation, thus bypassing the starter router associated with the starter 220. When a positive cycle of the input voltage $V_{AC}$ may be utilized, the power signal may travel through the seventh power input route from D3 to the driving circuit 250. When a negative cycle of the input voltage $V_{AC}$ may be utilized, the power signal may travel through the seventh power input route from D4 to the driving circuit 250.

Figure 10:
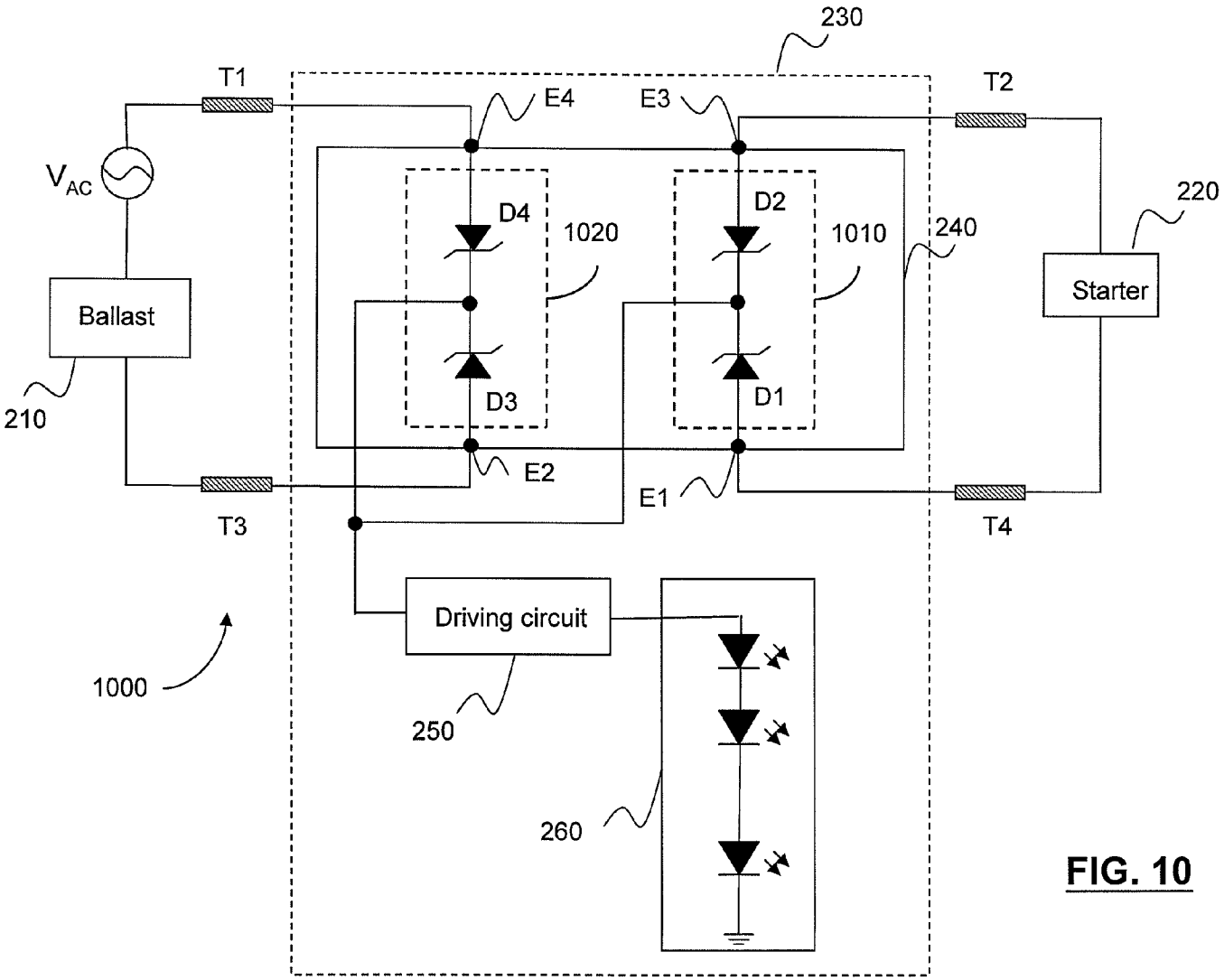
FIG. 10 shows a circuit diagram of an eighth illustrative embodiment the fluorescent-based electroluminescent lighting system of FIG. 2.

FIG. 10 shows a fluorescent-based electroluminescent lighting system 1000 in which the electroluminescent tube 230 may be installed in an eighth orientation, so that the electrodes E4 and E2 for a second half bridge rectifier 1020 are coupled to terminals T1 and T3, respectively, and the electrodes E3 and E1 for a first half bridge rectifier 1010 are coupled to terminals T2 and T4, respectively. The second half bridge rectifier 1020 may include two diodes, D3 and D4. An anode of D3 may be coupled to the electrode E2, and a cathode of the same D3 may be coupled to the driving circuit 250. An anode of D4 may be coupled to the electrode E4, and a cathode of the same D4 may be coupled to the same driving circuit 250.

When the fluorescent-based electroluminescent lighting system 1000 is turned on, the power signal provided by the ballast 210 may be transmitted to the driving circuit 250 and the electroluminescent device 260 via an eighth power input route between the electrodes E4 and E2 supported by the second half bridge rectifier 1020. Moreover, given this eighth orientation of the electroluminescent tube 230, the electrodes E3 and E1 supported by the first half bridge rectifier 1010 may be configured not to be in operation, thus bypassing the starter router associated with the starter 220. When a positive cycle of the input voltage $V_{AC}$ may be utilized, the power signal may travel through the eighth power input route from D4 to the driving circuit 250. When a negative cycle of the input voltage $V_{AC}$ may be utilized, the power signal may travel through the eighth power input route from D3 to the driving circuit 250.

As has been demonstrated above, various embodiments of the rectifying circuit 240 may be configured to bypass the starter route associated with the starter 220 to prevent the occurrence of a large voltage kick, which may damage the electroluminescent device 260. At the same time, the rectifying circuit 240 may also be configured to support a power input route through which the power signal may be transmitted to the driving circuit 250, regardless of the orientation of the electroluminescent tube 230. Thus, the electroluminescent tube 230 may be compatible with any conventional fluorescent lighting system.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I claim:

1. An electroluminescent tube, comprising:
first to fourth electrodes;
an electroluminescent device;
a driving circuit configured to drive the electroluminescent device upon receiving a power signal; and
a rectifying circuit configured to direct the power signal to the driving circuit through a power input route and bypass a starter route, wherein the rectifying circuit comprises
a first full bridge rectifier configured to support the power input route between the first electrode and the third electrode, and
a second full bridge rectifier configured to bypass the starter route between the second electrode and the fourth electrode.

2. The electroluminescent tube of claim 1, wherein the first full bridge rectifier comprises:
a first diode having an anode coupled to the first electrode;
a second diode having an anode coupled to the third electrode and a cathode coupled to a cathode of the first diode;
a third diode having a cathode coupled to the first electrode; and
a fourth diode having an anode coupled to an anode of the third diode and a cathode coupled to the third electrode.

3. The electroluminescent tube of claim 2, wherein the second full bridge rectifier comprises:
a fifth diode having an anode coupled to the second electrode;
a sixth diode having an anode coupled to the fourth electrode and a cathode coupled to a cathode of the fifth diode;
a seventh diode having a cathode coupled to the second electrode; and
an eighth diode having an anode coupled to an anode of the seventh diode and a cathode coupled to the fourth electrode.

4. An electroluminescent tube, comprising:
first to fourth electrodes;
an electroluminescent device;
a driving circuit configured to drive the electroluminescent device upon receiving a power signal; and
a rectifying circuit configured to direct the power signal to the driving circuit through a power input route and bypass a starter route,
wherein the rectifying circuit comprises a first half bridge rectifier configured to support the power input route between the first electrode and the third electrode, and a second half bridge rectifier configured to support the power input route between the second electrode and the fourth electrode.

5. The electroluminescent tube of claim 4, wherein the first half bridge rectifier comprises:

a first diode having an anode coupled to the first electrode; and a second diode having an anode coupled to the third electrode and a cathode coupled to a cathode of the first diode.

6. The electroluminescent tube of claim 5, wherein the second half bridge rectifier comprises:

a third diode having an anode coupled to the second electrode; and a fourth diode having an anode coupled to the fourth electrode and a cathode coupled to a cathode of the third diode.

7. A fluorescent-based electroluminescent lighting system, comprising:

an electroluminescent device;

a ballast configured to provide a power signal based on an input voltage;

a driving circuit configured to drive the electroluminescent device upon receiving the power signal;

a starter configured to support a starter route between a second terminal and a fourth terminal of the fluorescent-based electroluminescent lighting system; and a rectifying circuit configured to bypass the starter route and direct the power signal to the driving circuit through a power input route between a first terminal and a third terminal of the fluorescent-based electroluminescent lighting system, wherein the rectifying circuit comprises a first full bridge rectifier configured to support the power input route between the first electrode and the third electrode, and a second full bridge rectifier configured to bypass the starter route between the second electrode and the fourth electrode.

8. The fluorescent-based electroluminescent lighting system of claim 7 further comprising an electroluminescent tube, wherein the electroluminescent tube includes the rectifying circuit, the electroluminescent device, and first to fourth electrodes, each coupled to one of the first to fourth terminals.

9. The fluorescent-based electroluminescent lighting system of claim 7, wherein the starter is configured to allow the power signal to pass through the starter route when a fluorescent tube is installed at the four terminals.

10. The fluorescent-based electroluminescent lighting system of claim 8, wherein the first full bridge rectifier comprises:

a first diode having an anode coupled to the first electrode and a cathode coupled to the driving circuit;

a second diode having an anode coupled to the third electrode and a cathode coupled to the driving circuit;

a third diode having an anode coupled to a bias voltage and a cathode coupled to the first electrode; and a fourth diode having an anode coupled to the bias voltage and a cathode coupled to the third electrode.

11. The fluorescent-based electroluminescent lighting system of claim 8, wherein the second full bridge rectifier comprises:

a fifth diode having an anode coupled to the second electrode and a cathode coupled to the driving circuit;

a sixth diode having an anode coupled to the fourth electrode and a cathode coupled to the driving circuit;

a seventh diode having an anode coupled to a bias voltage and a cathode coupled to the second electrode; and an eighth diode having an anode coupled to the bias voltage and a cathode coupled to the fourth electrode.

12. The fluorescent-based electroluminescent lighting system of claim 10, wherein the electroluminescent tube is installed in a first orientation, so that the first full bridge rectifier is configured to direct the power signal to the driving circuit through the first electrode, the first diode, the fourth diode, and the third electrode during a positive cycle of the input voltage and through the third electrode, the second diode, the third diode, and the first electrode during a negative cycle of the input voltage.

13. The fluorescent-based electroluminescent lighting system of claim 10, wherein the electroluminescent tube is installed in a second orientation, so that the first full bridge rectifier is configured to direct the power signal to the driving circuit through the third electrode, the second diode, the third diode, and the first electrode during a positive cycle of the input voltage and through the first electrode, the first diode, the fourth diode, and the third electrode during a negative cycle of the input signal.

14. A fluorescent-based electroluminescent lighting system, comprising:

an electroluminescent device;

a ballast configured to provide a power signal based on an input voltage;

a driving circuit configured to drive the electroluminescent device upon receiving the power signal;

a starter configured to support a starter route between a second terminal and a fourth terminal of the fluorescent-based electroluminescent lighting system; and a rectifying circuit configured to bypass the starter route and direct the power signal to the driving circuit through a power input route between a first terminal and a third terminal of the fluorescent-based electroluminescent lighting system, wherein the rectifying circuit comprises a first half bridge rectifier configured to support the power input route between the first electrode and the third electrode, and a second half bridge rectifier configured to bypass the starter route between the second electrode and the fourth electrode.

15. The fluorescent-based electroluminescent lighting system of claim 14, wherein the first half bridge rectifier comprises:

a first diode having an anode coupled to the first electrode and a cathode coupled to the driving circuit; and a second diode having an anode coupled to the third electrode and a cathode coupled to the driving circuit.

16. The fluorescent-based electroluminescent lighting system of claim 15, wherein the electroluminescent tube is installed in a first orientation, so that the first half bridge rectifier is configured to direct the power signal to the driving circuit through the first electrode and the first diode during a positive cycle of the input voltage and through the third electrode and the second diode during a negative cycle of the input voltage.

17. The fluorescent-based electroluminescent lighting system of claim 15, wherein the electroluminescent tube is installed in a second orientation, so that the first half bridge rectifier is configured to direct the power signal to the driving circuit through the third electrode and the second diode during a positive cycle of the input voltage and through the first electrode and the first diode during a negative cycle of the voltage signal.

18. The fluorescent-based electroluminescent lighting system of claim 15, wherein the second half bridge rectifier comprises:

a third diode having an anode coupled to the second electrode and a cathode coupled to the driving circuit; and a fourth diode having an anode coupled to the fourth electrode and a cathode coupled to the driving circuit.

* * * * *